US006820626B1

(12) United States Patent
Jonke et al.

(10) Patent No.: US 6,820,626 B1
(45) Date of Patent: Nov. 23, 2004

(54) ENCAPSULATED DETERGENT

(75) Inventors: Hermann Jonke, Duesseldorf (DE); Brigitte Giesen, Duesseldorf (DE); Daniela Poethkow, Krefeld (DE); Alexander Ditze, Duesseldorf (DE); Dagmar Zaika, Mettmann (DE)

(73) Assignee: Henkel Kommandirgesellschaft auf Akrien, Duesseldorf (DE)

( * ) Notice: Subject to any disclaimer, the term of this patent is extended or adjusted under 35 U.S.C. 154(b) by 0 days.

(21) Appl. No.: 09/856,861

(22) PCT Filed: Nov. 16, 1999

(86) PCT No.: PCT/EP99/08806

§ 371 (c)(1),
(2), (4) Date: May 25, 2001

(87) PCT Pub. No.: WO00/31232

PCT Pub. Date: Jun. 2, 2000

(30) Foreign Application Priority Data

Nov. 25, 1998 (DE) ..... 198 54 267

(51) Int. Cl.[7] ..... B08B 3/04; C11D 1/12; C11D 1/83; C11D 3/37; C11D 17/08

(52) U.S. Cl. ..... 134/25.2; 134/25.3; 134/39; 134/40; 134/42; 510/235; 510/238; 510/239; 510/240; 510/414; 510/426; 510/441; 510/475

(58) Field of Search ..... 510/235, 238, 510/239, 240, 414, 426, 441, 475; 134/25.2, 25.3, 39, 40, 42

(56) References Cited

U.S. PATENT DOCUMENTS

| | | | | |
|---|---|---|---|---|
| 3,705,102 A | | 12/1972 | Mast | 252/89 |
| 4,305,749 A | | 12/1981 | Mildenberger et al. | 71/67 |
| 4,597,885 A | * | 7/1986 | Berry et al. | 252/93 |
| 4,664,839 A | | 5/1987 | Rieck | 252/175 |
| 4,820,439 A | | 4/1989 | Rieck | 252/135 |
| 5,356,607 A | | 10/1994 | Just | 423/334 |
| 5,417,951 A | | 5/1995 | Just | 423/334 |
| 5,501,814 A | | 3/1996 | Engelskirchen et al. | 252/174.17 |

FOREIGN PATENT DOCUMENTS

| | | | | |
|---|---|---|---|---|
| DE | 10 69 334 | | 11/1959 | |
| DE | 24 12 837 | | 10/1989 | |
| EP | 0 022 551 | | 7/1980 | |
| EP | 0 164 514 | | 4/1985 | |
| EP | 0 261 754 | | 3/1988 | |
| EP | WO 94/14941 | * | 7/1994 | C11D/3/386 |
| EP | 0 347 110 B1 | | 5/1995 | |
| GB | 1473201 | | 5/1977 | |
| GB | 1473202 | | 5/1977 | |
| WO | WO91/08171 | | 6/1991 | |
| WO | WO93/08251 | | 4/1993 | |
| WO | WO94/14941 | | 7/1994 | |

OTHER PUBLICATIONS

U. Ploog, Seifen–Ole–Fette–Wachse, 198, 373 (1982) Jul. 1982; Not Translated.
A. O;Lennick et al., HAPPI, Nov. 70 (1986) Nov. 1986.
S. Holzman et al, Tens. Detergent 23, 309 (1986) no month given.
R. Bibo et al., Soap Cosm. Chem. Spec. Apr. 46 (1990) Apr. 1990.
P. Ellis et al., Euro. Cosm. 1, 14 (1994) Jul. 1994.

* cited by examiner

*Primary Examiner*—Brian P Mruk
(74) *Attorney, Agent, or Firm*—Stephen D. Harper; Glenn E. J. Murphy

(57) ABSTRACT

An encapsulated active substance for a manual detergent for hard surfaces comprises an essentially anhydrous active substance with at least one surfactant and at least one liquid polymer carrier encapsulated in a water-soluble or water-dispersible capsule, the active substance containing: less than 25 wt. % of carrier; at least one unbranched or branched, acryclic or cyclic, saturated or unsaturated alcohol with 1 to 10 carbon atoms and one or two primary, secondary or tertiary hydroxy groups and a carbon chain optionally having one or more —O— groups; or being free of glycerol. The encapsulated active substance can be used as a manual detergent for hard surfaces.

13 Claims, No Drawings

ENCAPSULATED DETERGENT

CROSS-REFERENCE TO RELATED APPLICATIONS

This application is a U.S. National Stage application filed under 35 U.S.C. § 371, claiming priority under 35 U.S.C. §§ 119 and 365 of International Application No. PCT/EP99/08806, filed Nov. 16, 1999, in the European Patent Office, and DE 198 54 267.4, filed Nov. 25, 1998, in the German Patent Office.

FIELD OF THE INVENTION

This invention relates to manual cleaning compositions for hard surfaces in the form of a substantially water-free surfactant-containing active substance encapsulated in a water-soluble or water-dispersible material.

BACKGROUND OF THE INVENTION

Conventional detergents/cleaners are generally formulated as thinly liquid to viscous aqueous liquids. On the one hand, a liquid formulation such as this is generally intended to achieve relatively uniform mixing of the active substances in the formulation; on the other hand, the liquid formulations enable the user, when preparing the actual dishwashing or cleaning liquor, to add the detergent/cleaner to the water used for dishwashing or cleaning without coming into hand contact with the product. Hand contact is often undesirable because, in concentrated form, the formulations frequently have an irritating effect on the skin that feels unpleasant to the user. However, the disadvantages of liquid formulations lie, for example, in the fact that a generally large amount of water normally has to be added to the product in order to incorporate solid active ingredients. Unfortunately, this is inappropriate for ecological and economic reasons. The presence of water in the formulations leads to a reduction in the active substance content because, basically, water does not have the requisite cleaning effect. Accordingly, the active substance content per unit weight or volume of the product is reduced by its formulation as a liquid.

Even relatively highly concentrated, commercially available liquid products normally still have a high percentage water content. In addition, the user tends to overdose such concentrates in practice.

However, if products of the type in question are formulated as solids, the user has inconveniently to use dosing aids for measuring the quantity to be added with the attendant risk of skin contact with the concentrated product which can lead to the consequences mentioned above.

Accordingly, both liquid and solid formulations of manual detergents/cleaners are attended by the disadvantage that exact, ecologically safe and repeatable dosing is difficult for the user to achieve. This is a disadvantage from the perspective of environmentally friendly application.

The problem addressed by the present invention was to provide a storable dosage form for manual detergents/cleaners which would enable highly concentrated, substantially water-free detergents/cleaners to be used simply and safely by the consumer without any of the disadvantages mentioned above.

WO 94114941 relates to water-based neutral or slightly alkaline machine dishwashing detergents that are free from anionic and cationic surfactants. The machine dishwashing detergents may be accommodated in water-soluble or water-dispersible containers consisting, for example, of gelatine.

EP-A0 261 754 relates to a foam bath in the form of a mixture of amine salts and long-chain alkyl ether sulfates, 25 to 35% by weight of liquid polyethylene glycols and glycerol encapsulated in an elastic gelatine capsule.

It has now been found that certain active substances containing concentrated mixtures of active ingredients such as occur, for example, in liquid water-based manual detergents/cleaners can be encapsulated in storable form in water-soluble or water-dispersible capsules and that correspondingly encapsulated active substances are eminently suitable for use as a manual detergent/cleaner.

DESCRIPTION OF THE INVENTION

Accordingly, the present invention relates to an encapsulated active substance for a manual cleaning composition for hard surfaces comprising A) a substantially water-free active substance containing
  (i) at least one surfactant and
  (ii) at least one liquid polymeric carrier and B) a water-soluble or water-dispersible capsule, the active substance
  (ii) containing the liquid polymeric carrier in a quantity, based on the active substance, of less than 25% by weight and/or
  (iii) containing at least one unbranched or branched, acyclic or cyclic, saturated or unsaturated alcohol containing 1 to 10 carbon atoms and one or two primary, secondary or tertiary hydroxy groups and a carbon chain optionally interrupted by one or more oxygen atoms —O—and/or
  (iv) being free from glycerol.

The present invention also relates to the use of an encapsulated active substance according to the invention as a manual cleaning composition for hard surfaces.

The present invention also relates to a process for the manual cleaning of a hard surface with a water-based cleaning liquor, the cleaning liquor being prepared by dissolving or dispersing at least one encapsulated active substance according to the invention in water.

The encapsulated active substances according to the invention are distinguished in particular by their high cleaning performance and their high stability in storage. Compared with encapsulated active substances with no liquid polymeric carrier, they show increased stability in storage. Instead of a high carrier content, they allow a higher content of detersive alcohol component and hence develop greater cleaning power. In addition, the encapsulated active substance according to the invention readily enables the cleaning composition to be provided with a gelatine content as part of the capsule to additionally boost cleaning performance.

In the context of the invention, "active substance" is understood to mean the entire content of the water-soluble or water-dispersible capsule. This can be confined to the components according to the invention as mentioned above or may even be a mixture with other additives as explained hereinafter. Accordingly, the expression "active substance" also encompasses substances which make only an indirect contribution, if any, to the cleaning effect such as, for example, perfume or dyes.

A "manual cleaning composition" or "manual hard surface cleaner" in the context of the invention is understood to be a cleaning product which is acquired by the user in concentrated form and which, for use, is dissolved in water with a temperature of up to about 60° C., for example a multipurpose cleaner or a manual dishwashing detergent (MOD). Hard surfaces, such as glass, ceramic, concrete, metal, plastic, and painted or polished surfaces can be subsequently cleaned with the cleaning liquor. The cleaning process is carried out manually by the user. "Manual cleaning" in the context of the invention is understood to be a cleaning process in which the user is in manual contact with the object to be cleaned. By "manual contact" is also meant a contact involving a mechanical aid, for example a cloth, a sponge, a brush or a scrubber.

MDDs are a subgroup of manual cleaning compositions. For use, MDDs are generally dissolved in water with a temperature of up to about 50° C. and the dishwashing liquor formed is used for the manual cleaning of dishes and pots and pans. So far as the expression "manual cleaning" is concerned, the foregoing observations apply.

"Substantially water-free" in the context of the present invention means that the active substance contains less than about 20% by weight, preferably less than about 15% by weight, more preferably less than about 10% by weight and most preferably less than about 5% by weight of free water, for example less than 9% by weight.

The expression "free water" stands for water which is not bound as water of crystallization or by adsorption in any of the components present in the active substance.

The active substance may be present in the capsule as a liquid, as a highly viscous paste or as a solid. It is preferably liquid or flowable.

Capsule

Basically, the capsule may assume any form although forms which can be efficiently and inexpensively produced are generally preferred. These include, for example, any forms that are symmetrical in rotation relative to at least one axis, for example the spherical form, elliptical forms or cylindrical forms, a capsule in the form of a cylinder closed at either end by hemispherical shells being preferred. The capsule may be in one or more parts, the one-piece or the two-piece, openable and closable form being preferred.

The capsule has a volume of about 0.1 to about 30 ml. This range includes the normal dosages for manual cleaning compositions in the domestic or industrial sector. The capsule preferably has a volume of about 0.1 to about 10 ml, more preferably in the range from about 0.2 to about 5 ml and most preferably in the range from about 0.2 to about 1 ml, for example 0.5 ml. If large quantities of a cleaning liquor are to be prepared, for example for industrial application, volumes of more than 30 ml may also be appropriate.

The capsule used in accordance with the invention is soluble in water or at least dispersible in water. In other words, the material of which the capsule consists dissolves at least partly or at least forms a dispersion after introduction into water so that the capsule becomes permeable and allows the exchange of material between the water surrounding the capsule and the ingredients encapsulated by the capsule.

The time required for at least partial dissolution of the capsule in water with a temperature of 35° C. is about 10 to 50 seconds and preferably about 20 to 40 seconds. The dissolving process may be assisted by stirring.

The capsule preferably consists of a material which contains at least one natural or synthetic polymer or a mixture of two or more thereof. The constituent material of the capsule preferably contains gelatine, polyvinyl alcohol, polyethylene glycol, cellulose ether, alginic acid and/or alginates or pectin acid or a mixture of two or more thereof. Gelatine is particularly preferred. In addition, the constituent material of the capsule may contain additives which influence its elasticity and solubility in water. The constituent material of the capsule preferably contains gelatine and a plasticizer, for example glycol, glycerol or sorbitol. The percentage content of plasticizers in the constituent material of the capsule is generally from about 10 to about 40% by weight.

Surfactant Component (i)

The active substance may contain one or more surfactants from the group of anionic surfactants, including soaps, nonionic surfactants, amphoteric surfactants or cationic surfactants as the surfactant component (i). The surfactant content of the active substance is in the range from 1 to 99% by weight, preferably in the range from 10 to 90% by weight, more preferably in the range from 20 to 80% by weight, most preferably in the range from 30 to 70% by weight and, in one most particularly preferred embodiment, is in the range from 40 to 60% by weight, for example 45 to 55% by weight.

Anionic surfactants.

Anionic surfactants in the context of the invention are, for example, alkyl benzenesulfonates, alkanesulfonates, olefin sulfonates, alkyl ether sulfonates, glycerol ether sulfonates, sulfofatty acids, alkyl or fatty alcohol sulfates, alkyl or fatty alcohol ether sulfates, glycerol ether sulfates, hydroxy mixed ether sulfates, monoglyceride (ether) sulfates, fatty acid amide (ether) sulfates, dialkyl sulfosuccinates, mono- and dialkyl sulfosuccinamates, sulfotriglycerides, amide soaps, ether carboxylic acid and salts thereof, fatty acid isethionates, fatty acid sarcosinates, fatty acid taurides, acyl lactinates, acyl oligoglycoside sulfates, protein fatty acid condensates (more particularly vegetable soya-based products) or alkyl (ether) phosphates or mixtures of two or more thereof.

Anionic surfactants from the group of alkyl sulfates and alkyl ether sulfates are particularly preferred for the purposes of the invention. These include, for example, surfactants corresponding to general formula I:

$$R^1(\text{—}CHR^2\text{—}CH_2O)_x\text{—}OSO_3M \quad (I)$$

and surfactants corresponding to general formula II:

$$R^3\text{—}OSO_3M \quad (II)$$

in which $R^1$ and $R^3$ independently of one another represent aliphatic, linear and/or branched $C_{6-22}$ alkyl groups and/or aromatic, optionally $C_{1-18}$-alkyl-substituted hydrocarbon radicals, $R^2$ stands for hydrogen and/or one or more $C_{1-4}$ alkyl groups, x is a number of 0.1 to 6 and M stands for metal cations or ammonium ions.

Where $R^2$ stands for hydrogen and/or one or more $C_{1-4}$ alkyl groups, the compounds corresponding to general formula I are sulfates of mixed ethers obtainable, for example, by alkoxylation of alcohols with ethylene oxide and a $C_{1-4}$ alkylene oxide and/or a mixture of several $C_{1-4}$ alkylene oxides. A mixed alkoxylation reaction such as this may also take place sequentially, in which case block copolyethers (x=2 or more) are formed. In the interests of clarity, formulae have not been shown for every possible form of the polyethers.

The active substance preferably contains a) at least one anionic surfactant corresponding to general formula I and/or b) at least one anionic surfactant corresponding to general formula II as surfactant.

In one particularly preferred embodiment, $R^1$ and $R^3$ independently of one another are aliphatic, linear $C_{8-16}$ hydrocarbon radicals which preferably emanate from oleochemical starting materials. In the latter case, the anionic surfactants are referred to as fatty alcohol ether sulfates.

Fatty alcohol ether sulfates are anionic surfactants which are industrially produced by $SO_3$ or chlorosulfonic acid (CSA) sulfation of fatty alcohol polyalkylene ethers and subsequent neutralization. Typical examples are the sulfates of addition products of on average 1 to 10 and, more particularly, 2 to 5 moles of ethylene oxide with caproic alcohol, caprylic alcohol, 2-ethylhexyl alcohol, capric alcohol, lauryl alcohol, isotridecyl alcohol, myristyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof, the sulfates generally being used in the form of their alkali metal salts, preferably sodium salts, or in the form of their alkaline earth metal salts, preferably magnesium salts, or as mixtures of two or more of the last-mentioned salts. Particularly preferred sulfates are, for example, the commercially available types Texapon N or Texapon K14 (products of Henkel KGBA, Düsseldorf).

In one particular embodiment of the invention, the active substance contains at least one surfactant corresponding to general formula I and at least one surfactant corresponding to general formula II. The ratio between the surfactant or the mixture of surfactants corresponding to general formula I and the surfactant or the mixture of surfactants corresponding to general formula II is preferably about 1:5 to about 5:1, more preferably about 1:1 to about 4:1 and most preferably about 1.5:1 to about 2.5:1.

For the cleaning performance of a composition for pretreating obstinate soils, a pH in the strongly alkaline range (pH above about 9) is generally appropriate. In this case, surfactants mainly act as wetting agents to improve the wetting of the surfaces to be treated with the cleaning liquor so that any surfactants with a sufficient wetting effect for this purpose may generally be used.

Accordingly, for encapsulated active substances according to the invention for removing obstinate soils, it is sufficient for only one surfactant of general formula II to be present.

The anionic surfactant content of the active substance is in the range from 0.1 to 99% by weight, preferably in the range from 1 to 80% by weight, more preferably in the range from 5 to 60% by weight, most preferably in the range from 10 to 45% by weight and, in one most particularly preferred embodiment, in the range from 13 to 35% by weight, for example 15 to 25% by weight.

Nonionic surfactants

Suitable nonionic surfactants are both high-foaming and low-foaming nonionic surfactants, depending on the particular application.

Typical examples of nonionic surfactants are fatty alcohol polyglycol ethers, alkylphenol polyglycol ethers, fatty acid polyglycol esters, fatty acid amide polyglycol ethers, fatty acid amine polyglycol ethers, alkoxylated triglycerides, alkyl oligoglycosides, fatty acid-N-alkyl glucamides, polyol fatty acid esters, sugar esters, sorbitan esters and polysorbates.

The manual cleaning compositions according to the invention preferably contain products of the addition of alkylene oxides onto linear aliphatic $C_{8-22}$ alcohols as nonionic surfactant or as nonionic surfactants in the active substance. Preferred alkylene oxides are ethylene oxide and propylene oxide. Ethylene oxide is particularly preferred. Typical examples of fatty alcohols are caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, behenyl alcohol, erucyl alcohol and brassidyl alcohol and the technical mixtures thereof obtained, for example, in the high-pressure hydrogenation of technical methylesters based on fats and oils or aldehydes from Roelen's oxosynthesis and as monomer fraction in the dimerization of unsaturated fatty alcohols. Particular preference is attributed to technical fatty alcohol mixtures in which the fatty alcohols present contain about 12 to about 18 carbon atoms, for example coconut, palm, palm kernel or tallow fatty alcohols.

The ethoxylation product of coconut fatty alcohols (the alcohols containing on average about 4 ethylene oxide units) is particularly preferred.

Other suitable nonionic surfactant(s) are the amides of alkyl carboxylic acids, preferably alkyl carboxylic acids containing about 6 to about 24 carbon atoms, with alkanolamides, preferably monoalkanolamides. The amides obtainable from natural or synthetic fatty acids and fatty acid cuts with aminoethanol are particularly preferred, the monoethanolamides from coconut fatty acid cuts, more particularly $C_{8-14}$ fatty acid cuts, and ethanolamine being most particularly preferred.

Other suitable nonionic surfactants are alkyl polyglycosides and fatty acid glucamides. The nonionic surfactant(s) may serve, for example, as a wetting agent in the manual cleaning composition or may be used to improve the detachment of fat-containing substances. Thus, even the so-called alkyl polyglycosides with the general formula $R^{10}O—(Z)_x$, for example, may be used as nonionic surfactant(s).

In these compounds, the alkyl group $R^{10}$ contains 6 to 22 carbon atoms and may be both linear and branched. Primary linear or 2-methyl-branched alkyl groups are preferred. Such alkyl groups $R^{10}$ are, for example, 1-octyl, 1-decyl, 1-lauryl, 1-myristyl, 1-cetyl and 1-stearyl groups. 1-Octyl, 1-decyl, 1-lauryl and 1-myristyl groups are particularly preferred. Where so-called "oxo alcohols" are used as starting materials, compounds with an odd number of carbon atoms in the alkyl chain predominate.

The alkyl polyglycosides usable in the active substance according to the invention may contain, for example, only one particular alkyl group $R^{10}$. However, the alkyl polyglycosides are normally produced from natural fats and oils or mineral oils. In this case, mixtures corresponding to the starting compounds or to the particular working up of these compounds are present as the alkyl groups $R^{10}$.

Particularly preferred alkyl polyglycosides are those in which $R^{10}$ stands essentially for $C_8$ and $Cl_{10}$ alkyl groups, essentially for $C_{12}$ and $C_{14}$ alkyl groups, essentially for $C_8$ to $C_{16}$ alkyl groups or essentially for $C_{12}$ to $C_{16}$ alkyl groups.

Any mono- or oligosaccharides may be used as the sugar unit Z. Sugars containing 5 or 6 carbon atoms and the corresponding oligosaccharides are normally used. Examples of such sugars are glucose, fructose, galactose, arabinose, ribose, xylose, lyxbse, allose, altrose, mannose, gulose, idose, talose and sucrose. Preferred sugar units are glucose, fructose, galactose, arabinose and sucrose; glucose is particularly preferred.

The alkyl polyglycosides usable in accordance with the invention contain on average 1.1 to 5 sugar units. Alkyl polyglycosides with values for x of 1.1 to 1.6 are preferred, alkyl polyglycosides in which x=1.1 to 1.4 being most particularly preferred.

The alkoxylated homologs of the alkyl polyglycosides mentioned may also be used in accordance with the invention. These homologs may contain on average up to 10 ethylene oxide and/or propylene oxide units per alkyl glycoside unit.

Also suitable for use in the manual cleaning compositions according to the invention are surfactants from the family of glucamides, for example alkyl-N-methyl glucamides, the term "alkyl" relating to alkyl groups with a chain length of about 6 to about 14 carbon atoms. It can be of advantage to use the described nonionic surfactants not as sole nonionic surfactant(s), but rather in admixture with at least one other nonionic surfactant, for example in combination with fatty alcohol ethoxylate, alkyl polyglycoside or in combination with fatty alcohol ethoxylate and glucamide or in combination with glucamide and alkyl polyglycoside. Quatemary or even higher combinations of the nonionic surfactants disclosed here are also possible.

In one preferred embodiment of the invention, the active substance contains at least one fatty alcohol polyglycol ether and/or at least one alkyl polyglycoside.

The nonionic surfactant content of the active substance is in the range from 0.1 to 99% by weight, preferably in the range from 1 to 80% by weight, more preferably in the range from 5 to 60% by weight, most preferably in the range from 10 to 45% by weight and, in one most particularly preferred embodiment, in the range from 15 to 35% by weight, for example 20 to 30% by weight.

In another preferred embodiment of the invention, the active substance contains at least one anionic or at least one nonionic surfactant, more particularly at least one anionic and at least one nonionic surfactant, for example at least one alkyl ether sulfate and at least one fatty alcohol polyglycol ether.

In another preferred embodiment of the invention, the ratio by weight of anionic to nonionic surfactants in the active substance is in the range from about 0.1 to about 10:1, preferably in the range from about 0.5 to about 2:1, more preferably in the range from about 0.6 to about 1.5:1 and most preferably in the range from about 0.7 to about 1.3:1, for example about 0.8:1.

Amphoteric Surfactants

Betaines, for example, may be used as amphoteric surfactant(s). Betaines are mainly obtained by carboxyalkylation, preferably carboxymethylation, of amino compounds. The starting materials are preferably condensed with halocarboxylic acids or salts thereof, especially sodium chloroacetate, 1 mol of salt being formed per mol of betaine. Another suitable method is the addition of unsaturated carboxylic acids, for example acrylic acid. Information on the nomenclature and above all on the difference between betaines and "true" amphoteric surfactants can be found in the article by U. Ploog in Seifen-Öle-Fette-Wachse, 198, 373 (1982). Other overviews on this subject have been published, for example, by A. O'Lennick et al. in HAPPI, Nov. 70 (1986), by S. Holzman et al. in Tens. Det 23, 309 (1986), by R. Bibo et al. in Soap Cosm. Chem. Spec. Apr. 46 (1990) and by P. Ellis et al. in Euro Cosm. 1, 14 (1994).

Examples of suitable betaines are the carboxyalkylation products of secondary and, more particularly, tertiary amines corresponding to general formula (III):

$$R^4—N^+(R^5)(R^6)—(CH_2)_nCOO^- \quad (III)$$

in which $R^4$ represents alkyl and/or alkenyl groups containing 6 to 22 carbon atoms, $R^5$ represents hydrogen or alkyl groups containing 1 to 4 carbon atoms, $R^6$ represents alkyl groups containing 1 to 4 carbon atoms and n is a number of 1 to 6.

Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof.

Also suitable are carboxyalkylation products of amidoamines which correspond to formula (IV):

$$R^7CO—NH—(CH_2)_m—N^+(R^5)(R^6)—(CH_2)_nCOO^- \quad (IV)$$

where $R^7CO$ is an aliphatic acyl group containing 6 to 22 carbon atoms and 0 or 1 to 3 double bonds, m is a number of 1 to 3 and $R^5$, $R^6$ and n are as defined above.

Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid, erucic acid and technical mixtures thereof, with N,N-dimethylaminoethyl amine, N,N-dimethylaminopropyl amine, N,N-diethylaminoethyl amine and N,N-diethylaminopropyl amine which are condensed with sodium chloroacetate. A condensation product of $C_{8/18}$ cocofatty acid-N,N-dimethylaminopropyl amide with sodium chloroacetate is preferably used.

Other suitable starting materials for the betaines to be used in accordance with the invention are imidazolines corresponding to formula (V):

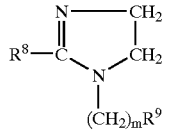

(V)

in which $R^8$ is an alkyl group containing 5 to 21 carbon atoms, $R^9$ is a hydroxyl group, an $OCOR^8$ or $NHCOR^8$ group and m is 2 or 3. These substances are also known substances which may be obtained, for example, by cyclizing condensation of 1 or 2 moles of fatty acid with polyfunctional amines, for example aminoethyl ethanolamine (AEEA) or diethylenetriamine. The corresponding carboxyalkylation products are mixtures of different open-chain betaines.

Typical examples are condensation products of the above-mentioned fatty acids with AEEA, preferably imidazolines based on lauric acid or $C_{12/14}$ cocofatty acid, which are subsequently betainized with sodium chloroacetate.

Liquid Polymeric Carrier Component (ii)

Natural or synthetic polymers liquid at room temperature may be used as the liquid polymeric carrier component (ii). Liquid polyethylene glycols such as PEG 600, for example, are particularly suitable. Accordingly, in one preferred embodiment of the invention, the active substance contains one or more polyethylene glycols.

The carrier content of the active substance is in the range from 0.1 to 50% by weight, preferably in the range from 1 to 40% by weight, more preferably in the range from 5 to 35% by weight, most preferably in the range from 10 to 30% by weight and, in one most particularly preferred embodiment, in the range from 15 to less than 25% by weight, for example between 20 and 24% by weight.

The active substance preferably contains as the alcohol component (iii) at least one unbranched, acyclic, saturated primary $C_{1-8}$ monoalcohol, one unbranched, acyclic saturated $C_{2-6}$ alkylene glycol and/or one unbranched, acyclic saturated $C_{2-6}$ alkylene glycol mono $C_{1-8}$-alkyl ether.

These are in particular the lower alcohols ethanol, propan-1-ol, propan-2-ol and butan-1-ol, the lower glycols ethylene glycol, 1,3-propylene glycol, 1,2-propylene glycol and 1,2-butylene glycol and hydroxy ethers, such as diethylene glycol, dipropylene glycol, ethylene glycol monobutyl ether, propylene glycol monobutyl ether, ethylene glycol monohexyl ether and propylene glycol monohexyl ether or mixtures thereof.

In one preferred embodiment of the invention, the active substance contains at least one unbranched, acyclic, saturated primary $C_{1-8}$ monoalcohol and one unbranched, acyclic saturated $C_{2-6}$ alkylene glycol mono-$C_{1-8}$-alkyl ether, more particularly together with an unbranched, acyclic, saturated $C_{2-6}$ alkylene glycol, for example ethanol, propylene glycol monobutyl ether and 1,2-propylene glycol. It can be of advantage to use the monoalcohol and the alkylene glycol monoalkyl ether in substantially the same quantities of 1 to 20% by weight, preferably 5 to 17% by weight and more preferably 7 to 15% by weight while the glycol is used in a quantity of preferably 0.1 to 10% by weight, more preferably 0.5 to 6% by weight and most preferably 1 to 3% by weight.

The alcohol content of the active substance is in the range from 0.1 to 50% by weight, preferably in the range from 1 to 45% by weight, more preferably in the range from 5 to 40% by weight, most preferably in the range from 10 to 35% by weight and, in one most particularly preferred embodiment, in the range from 15 to 30% by weight, for example between 20 and 28% by weight.

In one particular embodiment of the invention, the active substance contains components (i), (ii) and (iii) in a ratio by weight of about 2:1:1, for example 1.9:1:1.1. In another particular embodiment where component (i) is a combination of anionic surfactant (i.1) and a nonionic surfactant (i.2), the ratio by weight of (i.1) to (i.2) to (ii) to (iii) may be about 1:1:1:1, for example 0.8:1.1:1:1.1.

Sequestering Agents

In addition, the active substance may optionally contain sequestering agents. Suitable sequestering agents are, for example, those from the class of aminopolycarboxylic acids and polyphosphonic acids. The aminopolycarboxylic acids include nitrilotriacetic acid, ethylenediamine tetraacetic acid, diethylenetriamine pentaacetic acid and higher homologs thereof. Suitable polyphosphonic acids are 1-hydroxyethane-1,1-diphosphonic acid, aminotri (methylenephosphonic acid), ethylenediamine tetra (methylenephosphonic acid) and higher homologs thereof, such as diethylenetetraamine tetra(methylenephosphonic acid). The acids mentioned are normally used in the form of their alkali metal salts, more particularly their sodium or potassium salts. Sodium nitrilotriacetate is preferably used and is employed in quantities of up to 10% by weight and preferably in quantities of 2% by weight to 6% by weight, based on the manual cleaning composition.

Other suitable sequestering agents are monomeric polycarboxylic acids or hydroxypolycarboxylic acids, more particularly in the form of their alkali metal salts, for example sodium citrate and/or sodium gluconate.

Preferred sequestering agents include homopolymeric and/or copolymeric carboxylic acids and alkali metal salts thereof, preferably the sodium or potassium salts. Particularly suitable sequestering agents of this type are polymeric carboxylates and polymeric carboxylic acids with a relative molecular weight ($M_n$) of at least about 350 in the form of their water-soluble salts, more particularly in the form of their sodium and/or potassium salts, for example oxidized polysaccharides according to WO-A 93/08251, polyacrylates, polyhydroxyacrylates, polymethacrylates, polymaleates and, more particularly, copolymers of acrylic acid with maleic acid or maleic anhydride, preferably those of 50 to 70% acrylic acid and 50 to 10% maleic acid as characterized, for example, in EP-A 022 551. The relative molecular weight of the homopolymers is generally between 1,000 and 100,000 while that of the copolymers is generally between 2,000 and 200,000 and preferably between 50,000 and 120,000, based on free acid.

Particularly preferred acrylic acid/maleic acid copolymers have a relative molecular weight of 50,000 to 100,000.

Suitable but less preferred compounds of this class are copolymers of acrylic acid or methacrylic acid with vinyl ethers, such as vinyl methyl ethers, vinyl esters, ethylene, propylene and styrene in which the percentage content of the acid is at least 50% by weight.

Other suitable polymeric carboxylates or carboxylic acids are terpolymers which contain two carboxylic acids and/or salts thereof as monomers and vinyl alcohol and/or a vinyl alcohol derivative or a carbohydrate as the third monomer. The first acidic monomer or its salt is derived from a monoethylenically unsaturated $C_{3-8}$ carboxylic acid and preferably from a $C_{3-4}$ monocarboxylic acid, more particularly from (meth)acrylic acid. The second acidic monomer or its salt may be a derivative of a $C_{4-8}$ a dicarboxylic acid, preferably a $C_{4-8}$ dicarboxylic acid, maleic acid being preferred. In this case, the third monomeric unit is formed by vinyl alcohol and/or preferably an esterified vinyl alcohol. Vinyl alcohol derivatives which represent an ester of short-chain carboxylic acids, for example $C_{1-4}$ carboxylic acids, with vinyl alcohol are particularly preferred. Preferred terpolymers contain 60 to 95% by weight and more particularly 70 to 90% by weight of (meth)acrylic acid or (meth)acrylate, preferably acrylic acid or acrylate, and maleic acid or maleate and 5 to 40% by weight and preferably 10 to 30% by weight of vinyl alcohol and/or vinyl acetate. Terpolymers in which the ratio by weight of (meth)acrylic acid or (meth)acrylate to maleic acid or maleate is between 1:1 and 4:1, preferably between 2:1 and 3:1 and more particularly between 2:1 and 2.5:1 are most particularly preferred. Both the quantities and the ratios by weight are based on the acids. The second acidic monomer or its salt may also be a derivative of an allylsulfonic acid substituted in the 2-position by an alkyl group, preferably a $C_{1-4}$ alkyl group, or an aromatic radical preferably derived from benzene or benzene derivatives.

Preferred terpolymers contain 40 to 60% by weight and more particularly 45 to 55% by weight of (meth)acrylic acid or (meth)acrylate, preferably acrylic acid or acrylate, 10 to 30% by weight and preferably 15 to 25% by weight of methallyl sulfonic acid or methallyl sulfonate and, as the third monomer, 15 to 40% by weight and preferably 20 to 40% by weight of a carbohydrate. This carbohydrate may be, for example, a mono-, di-, oligo- or polysaccharide. Mono-, di- or oligosaccharides are preferred, sucrose being particularly preferred. The use of the third monomer introduces predetermined weak spots into the polymer which are responsible for its degradability. The terpolymers used can be produced by known, standard methods. Terpolymers either completely or at least partly neutralized, more particularly more than 50% neutralized, based on the carboxyl groups present, are also preferably used.

Polyacetal carboxylic acids obtained, for example, by polymerization of esters of glycolic acid, introduction of stable terminal groups and saponification to the sodium or potassium salts may also be used. Also suitable are polymeric acids obtained by polymerization of acrolein and Canizzaro disproportionation of the polymer with strong alkalis. They are essentially made up of acrylic acid units and vinyl alcohol units or acrolein units.

The percentage content of organic carboxyl-containing builders in the active substance according to the invention may be up to 10% by weight and is preferably in the range from 1% by weight to 7.5% by weight and more preferably in the range from 2% by weight to 5% by weight while the content of polyphosphonic acids is up to 3% by weight, preferably in the range from 0.05% by weight to 1.5% by weight and more preferably in the range from 0.1% by weight to 1% by weight. These substances are also used in water-free form.

According to the invention, other suitable sequestering agents are crystalline alkali metal silicates, for example soda waterglass (modulus 2), and fine-particle alkali metal alumosilicates, more particularly zeolites of the NaA type. Suitable zeolites have a calcium binding capacity of 100 to 200 mg CaO/g (according to DE-C 24 12 837). Their particle size is normally in the range from 1 $\mu$m to 10 $\mu$m. They are used in dry form. In the present case, the water present in combined form in the zeolites is not problematical. Preferred crystalline silicates, which may be present either on their own or together with the alumosilicates mentioned, are crystalline layer silicates with the formula $NaMSi_xO_{2+x}.yH_2O$, where M is sodium, x is a number of 1.9 to 4 and y is a number of 0 to 20. Preferred values for x are 2, 3 or 4. Crystalline layer silicates such as these are described, for example, in European patent application EP-A 16.4 514. Both β- and δ-sodium disilicates $Na_2Si_2O_5.yH_2O$ are particularly preferred, β-sodium disilicate being obtainable, for example, by the process described in WO-A 91/08171. Suitable crystalline silicates are commercially available under the names of SKS-6 (manufacturer: Hoechst) and Nabion®) 15 (manufacturer: Rhône-Poulenc). The content of inorganic builders in the manual cleaning composition may be up to about 80% by weight or lower, preferably up to about 25% by weight and, more particularly, about 10% by weight to about 25% by weight.

The manual cleaning compositions according to the invention are preferably phosphate-free. If the presence of phosphate is ecologically acceptable (for example were phosphate-eliminating wastewater treatment is available), polymeric alkali metal phosphates, such as sodium tripolyphosphate, may also be present Their percentage content may be up to about 50% by weight and is preferably up to about 45% by weight, based on the composition as a whole, the percentage content of the other solids, for example the alkali metal silicate and/or alumosilicate, being reduced accordingly.

In addition, small quantities of dyes, perfume oils, enzymes, bleaching agents, activators, complexing agents and similar substances typically encountered in dishwashing detergents and/or cleaners may also be present as additives in the active substance.

Alternatively, these additives—either individually or in admixture and optionally in dissolved or dispersed form—may be completely or partly coated with a water-soluble or water-dispersible material separately from the encapsulated active substance according to the invention and, together with one or more different encapsulated active substances according to the invention, may form a building block system with two or more different encapsulated active substances with which the consumer is able to prepare a water-based cleaning liquor individually adapted to the particular application by appropriate qualitative and quantitative selection of the encapsulated active substances to be combined with one another. Equally, a combination of encapsulated active substances put together for a particular application may be presented to the consumer in a form packaged in an optionally water-soluble wrapping, for example in the form of a water-soluble and/or tearable film of a standard material, such as polyvinyl alcohol, plastic or metal or combinations thereof.

Accordingly, the present invention also relates to a system containing two or more different encapsulated active substances of which at least one is an encapsulated active substance according to the invention.

Besides one or more different encapsulated active substances according to the invention differing, for example, in their surfactant component, a system such as this contains one or more encapsulated active substances each containing one or more additives, more particularly from the group of surfactants, sequestering agents, adds (for example citric acid, acetic acid, formic acid, amidosulfuric acid, hydrochloricacid, sulfuric acid; for example for descaling or cleaning sanitary ware, such as baths or lavatories), bases (for example alkali metal and alkaline earth metal hydroxides and carbonates, such as sodium hydroxide or carbonate, and ammonia and amines; for example for cleaning in the kitchen), bleaching agents (for example oxygen bleaching agents, such as peroxides, for example hydrogen peroxide, or chlorine bleaching agents, such as alkali metal hypochlorites; for example for the special cleaning of bleachable soils), antimicrobial agents (for example for hygienic cleaning), care components (for example liposomes for skin care), perfumes (for example for individual fragrances and aesthetics) and dyes (for example for individual visual effects and aesthetics).

In order to distinguish between the various encapsulated active substances of the building block system, the capsules and/or—particularly in the case of transparent or translucent capsules—the active substances preferably have different colors, transparent and translucent and white, gray tones and black also being regarded as colors, and/or the capsules have different sizes or volumes and/or different shapes.

In one preferred embodiment of the process according to the invention for the manual cleaning of a hard surface with a water-based cleaning liquor, the cleaning liquor is prepared by dissolving or dispersing one to five encapsulated active substances according to the invention in 0.1 to 10 liters of water.

Instead of one to five encapsulated active substances according to the invention, the process according to the invention may equally well be carried out with one to five encapsulated active substances of the system according to the invention.

The pH value of the water-based cleaning liquor obtained is generally between about pH 5 and about pH 14.

Thus, as manual dishwashing detergents (MDDs), encapsulated active substances are preferably formulated in such a way that the water-based cleaning liquor obtained has a pH in the neutral to slightly acidic range, for example a pH of up to about 8 and more particularly in the range from about 5.5 to about 7.5.

As multipurpose cleaners and the like, the encapsulated active substances according to the invention are preferably formulated in such a way that the water-based cleaning liquor has a pH in the range from about 6 to about 11 and more particularly in the range from about 6.5 to about 10.5, for example about 7 or even about 9 or about 10.

For removing obstinate soils, the encapsulated active substances may also be formulated in the more highly alkaline range so that the water-based cleaning liquor has a pH value of about 9 to about 14 and preferably in the range from about 10 to about 13.5.

EXAMPLES

Example 1

Multipurpose Cleaner/Manual Dishwashing Detergent

A cleaning composition containing the ingredients listed below was encapsulated in 0.5 ml spherical, elastic gelatine capsules:

| | |
|---|---|
| 19% by weight | sodium lauryl ether sulfate containing on average 2 ethylene oxide units (EO) |
| 25.2% by weight | $C_{12-14}$ fatty alcohol containing on average 4 EO |
| 9.5% by weight | ethanol |
| 12.6% by weight | propylene glycol monobutyl ether |
| 23.0% by weight | polyethylene glycol PEG 600 |
| 1.9% by weight | propylene glycol |
| 0.6% by weight | perfume |
| 8.2% by weight | water |

The composition had a pH of 8.5. The capsules were stable in storage for 4 weeks both at room temperature and at 400° C.

Example 2

Cleaning Performance

Cleaning liquors E1 to E6 differing in concentration (conc.) were prepared by dissolving 1 or 5 capsules (C.) of Example 1 in 0.1, 1 or 10 liters of water and were tested for cleaning performance by the Gardner test. The cleaning performance of the cleaning liquor V1 of a commercially available multipurpose cleaner, which contained 6 ml of the cleaner in 1 liter of water (recommended dosage), was tested for comparison. E5 had a pH value of 7.

Cleaning performance was determined—unless otherwise indicated—to the Qualitätsnonnen fäir Ful3bodenpflege-und reinigungsmittel (Quality Standards for Floor Care and Cleaning Products) of the Industrieverband Putz-und Pflegemittel e.V. (IPP), Frankfurt/M. (Seifen-Öle-Fette-Wachse) 1986, 112, 371–372) for dilute products. In this test, a white dirt/soil carrier treated with test soil is wiped under defined conditions with a sponge soaked with the test liquid and the cleaning effect is photoelectrically measured against the untreated white soil carrier.

The wiper used similar to the Waschbarkeits-und Scheuerprüfgerät 494 (Washability and Scouing Tester 494) of Erichsen GmbH, D-58675 Hemer-Sundwig with a brass guide rail and an 820 g attached weight. Whiteness was measured with a Dr. Lange Micro-Color (an instrument for measuring color difference, manufacturer Dr. Lange, D-40549 Düsseldorf), the result being expressed as the average of 21 measurements per test strip.

Cleaning performance (CP) was measured three times and is shown in the Table as CP in %.

TABLE

| | E1 | E2 | E3 | E4 | E5 | E6 | V1 |
|---|---|---|---|---|---|---|---|
| Conc. | 1 C./ 0.1 l | 5 C./ 0.1 l | 1 C./ 1 l | 5 C./ 1 l | 1 C./ 10 l | 5 C./ 10 l | 6 ml/ 1 l |
| Cp | 83 | 86 | 69 | 71 | 52 | 66 | 53 |

The cleaning performance of a liquor prepared with only one capsule in 10 liters of water (E%) is almost as high as that of a conventional liquor containing 6 ml of cleaner per liter of water (V1). A liquor prepared with one capsule per liter of water (E3) shows distinctly increased cleaning performance in relation to V1. In the case of E4, E1and E2, cleaning performance can be controllably increased as required through the number of capsules.

What is claimed is:

1. A manual cleaning composition for hard surfaces comprising a substantially water-free active substance containing at least one surfactant and at least one liquid polymeric carrier encapsulated in a water-soluble or water-dispersible capsule, wherein the active substance:

(i) contains the liquid polymeric carrier in a quantity of less than 25% by weight;

(ii) is optionally free of glycerol; and (iii) contains:

a) at least one anionic surfactant of formula (I):

$$R^1(\text{—}CHR^2\text{—}CH_2O)_x\text{—}OSO_3M \quad (I)$$

or b) at least one anionic surfactant of formula II:

$$R^3\text{—}OSO_3M \quad (II)$$

in which formulae I and II $R^1$ and $R^3$ independently of one another represent aliphatic, linear and/or branched $C_{6-22}$ alkyl groups and/or aromatic, optionally $C_{1-18}$-alkyl-substituted hydrocarbon radicals, $R^2$ stands for hydrogen and/or one or more $C_{1-4}$ alkyl groups, x is a number of 0.1 to 6, and M stands for metal cations or ammonium ions, or c) at least one alkyl ether sulfate and at least one fatty alcohol polyglycol ether.

2. The manual cleaning composition of claim 1, wherein the active substance contains at least one anionic or nonionic surfactant.

3. The manual cleaning composition of claim 1, wherein the active substance contains at least one anionic and at least one nonionic surfactant.

4. The manual cleaning composition of claim 1, wherein the active substance contains at least one fatty alcohol polyglycol ether and/or at least one alkyl polyglycoside.

5. The manual cleaning composition of claim 1, wherein the liquid polymeric carrier comprises one or more polyethylene glycols.

6. The manual cleaning composition of claim 1, wherein the active substance contains at least one unbranched, acyclic, saturated primary $C_{1-8}$ monoalcohol, one unbranched, acyclic saturated $C_{2-6}$ alkylene glycol and/or one unbranched, acyclic saturated $C_{2-6}$ alkylene glycol mono-$C_{1-8}$-alkyl ether.

7. The manual cleaning composition of claim 1, wherein the active substance contains one or more amphoteric surfactants or sequestering agents.

8. The manual cleaning composition of claim 1, wherein the capsule comprises at least one natural or synthetic polymer.

9. The manual cleaning composition of claim 1, wherein the capsule comprises gelatine.

10. The manual cleaning composition of claim 1, wherein the capsule has a volume of 0.1 to 30 ml.

11. A process for the manual cleaning of a hard surface with a water-based cleaning liquor, comprising the steps of forming a cleaning liquor by dissolving or dispersing the composition of claim 1 in an aqueous medium, and applying the cleaning liquor manually to the hard surface to effect cleaning thereof.

12. A system comprising the composition of claim 1 and at least one other different encapsulated active substance.

13. A manual cleaning composition for hard surfaces comprising an active substance containing 10% to 90% by weight of at least one surfactant, 5% to 35% by weight of at least one liquid polymeric carrier, and less than at 20% by weight of free water, said active substance being encapsulated in a water-soluble or water-dispersible gelatinous capsule, wherein the active substance: (i) contains 5% to 40% by weight of at least one unbranched or branched, acyclic or cyclic, saturated or unsaturated alcohol containing 1 to 10 carbon atoms and one or two primary, secondary or tertiary hydroxy groups and a carbon chain optionally containing one or more oxygen atoms —O—; or (ii) is free of glycerol, and wherein the at least one surfactant comprises:

a) at least one anionic surfactant of formula (I):

$$R^1(\text{—}CHR^2\text{—}CH_2O)_x\text{—}OSO_3M \quad (I)$$

or b) at least one anionic surfactant of formula II:

$$R^3\text{—}OSO_3M \quad (II)$$

in which $R^1$ and $R^3$ independently of one another represent aliphatic, linear and/or branched $C_{6-22}$ alkyl groups and/or aromatic, optionally $C_{1-18}$-alkyl-substituted hydrocarbon radicals, $R^2$ stands for hydrogen and/or one or more $C_{1-4}$ alkyl groups, x is a number of 0.1 to 6, and M stands for metal cations or ammonium ions.

* * * * *

UNITED STATES PATENT AND TRADEMARK OFFICE

CERTIFICATE OF CORRECTION

PATENT NO. : 6,820,626 B1
DATED : November 24, 2004
INVENTOR(S) : Jonke et al.

It is certified that error appears in the above-identified patent and that said Letters Patent is hereby corrected as shown below:

Title page,
Item [73], Assignee, delete "Kommandirgesellschaft" and insert -- Kommanditgesellschaft --, and delete "Akrien" and insert -- Aktien --.

Column 15,
Line 16, delete "at".

Signed and Sealed this

Thirtieth Day of August, 2005

JON W. DUDAS
*Director of the United States Patent and Trademark Office*